United States Patent [19]

Walker

[11] 3,996,265

[45] Dec. 7, 1976

[54] PREPARATION OF N-ALKYL TEREPHTHALAMATES

[75] Inventor: James H. Walker, Vallejo, Calif.

[73] Assignee: Chevron Research Company, San Francisco, Calif.

[22] Filed: Dec. 3, 1974

[21] Appl. No.: 529,152

[52] U.S. Cl. ..... 260/471 R; 260/558 R; 260/558 P

[51] Int. Cl.[2] ..... C07C 102/06

[58] Field of Search ..... 260/471 R, 558 R, 558 P

[56] References Cited

UNITED STATES PATENTS

| | | | |
|---|---|---|---|
| 2,711,415 | 6/1955 | Cottle et al. | 260/558 R X |
| 2,798,087 | 7/1957 | Hotten | 260/471 R |
| 2,808,433 | 10/1957 | Struve | 260/471 R X |
| 3,763,234 | 10/1973 | Brill | 260/558 R X |

*Primary Examiner*—Richard L. Raymond
*Attorney, Agent, or Firm*—G. F. Magdeburger; C. J. Tonkin; J. T. Brooks

[57] ABSTRACT

A process for preparing N-alkyl terephthalamates is disclosed and comprises contacting within a liquid phase reaction medium a di($C_1$–$C_4$ alkyl) terephthalate and a $C_8$–$C_{30}$ primary or secondary monoamine in the presence of 0.1–10 weight percent based on the weight of the reactants of boric acid.

5 Claims, No Drawings

PREPARATION OF N-ALKYL TEREPHTHALAMATES

BACKGROUND OF THE INVENTION

N-alkyl monoesters of terephthalamic acids are useful as intermediates in the preparation of grease-thickening agents. As described in U.S. Pat. No. 2,820,012 and others, the terephthalamate esters are reacted with metal bases to form metal terephthalamate thickening agents. These thickening agents, when prepared within a lubricating oil, thicken the oil to the consistency of grease.

There are several conventional methods for preparing N-alkyl terephthalamate esters. Most of these processes, however, require multi-step operations resulting in high operating costs and long processing times. In fact, some of these multi-step processes have been known to consume as much time as six days in processing time.

SUMMARY OF THE INVENTION

I have found a process for preparing N-alkyl terephthalamates by a one-step process. In this process, a di($C_1$-$C_4$ alkyl) terephthalamate is reacted directly with a $C_8$-$C_{30}$ primary or secondary monoamine. The process is conducted by using from 0.1–10 weight percent, based on the weight of the reactants, of a boric acid catalyst.

DETAILED DESCRIPTION OF THE INVENTION

N-alkyl terephthalamates, which are suitable for use as intermediates in preparing metal terephthalamate greases may be prepared by a one-step process of the instant invention. In this process, a di($C_1$-$C_4$) alkyl terephthalate is contacted with a mono or secondary amine having from 8 to 30 carbons within a suitable liquid reaction medium in the presence of 0.1–10 weight percent, preferably from 0.2–2 weight percent, based on the weight of said reactants, of boric acid.

The molar ratio of the dialkyl terephthalate to mono or secondary amine generally ranges from 0.8 to 1.5:1 although it is preferred that a molar ratio of 1 to 1.2:1 be employed. The reaction is conducted at a temperature from 130° to 460° F and preferably from 250° to 300° F under sufficient pressure to maintain liquid phase reaction conditions. The time of reaction generally varies from 5 to 50 hours and preferably from 10 to 30 hours.

The reaction may be conducted with or without an inert reaction solvent. If a reaction solvent is employed, it will be present in an amount varying from 0 to 50 weight percent of the reaction mixture. Exemplary reaction solvents include inert, stable, aliphatic and aromatic hydrocarbons and mixtures thereof, chlorinated aromatic hydrocarbons, etc. The aliphatic and aromatic hydrocarbon solvents and mixtures thereof are preferred. Exemplary solvents of this type include benzene, toluene, xylene, heptane, octane, decane, dodecane, petroleum lubricating oil, etc.

The reaction products of this reaction are N-alkyl terephthalamates and the N,N′-dialkyl terephthalamates as well as small amounts of unreacted dialkyl terephthalate and monoamine. The N-alkyl terephthalamates are present in an amount usually ranging from 65 to 80 percent, and more usually from 70 to 74 percent of the reaction product, not including the reaction solvent and by-product alcohol. The alcohol by-product is removed by azeotropic distillation, preferably prior to stripping of the solvent. The solvent and unreacted components may be stripped from the reaction product by conventional methods. The stripping step is preferably conducted by reducing the pressure 28 to 29 inches of mercury absolute and increasing the temperature from 250° to 300° F. The stripping step is usually conducted for 2 to 6 hours. The solvent may then be recycled to the process.

The N-alkyl terephthalamates may be further separated from the N,N′-dialkyl terephthalamates and boric acid catalyst by conventional separating means. However, it has been found that excellent grease compositions may be prepared by using this mixed intermediate reaction product in preparing the metal terephthalamate greases.

The dialkyl terephthalates used in the instant process include the di($C_1$-$C_4$ alkyl) terephthalates and preferably the di($C_1$-$C_2$ alkyl) terephthalates. Exemplary dialkyl terephthalates include dimethyl terephthalate, diethyl terephthalate, methyl ethyl terephthalate, dipropyl terephthalate, methyl propyl terephthalate, dibutyl terephthalate, etc. The preferred dialkyl terephthalate is dimethyl terephthalate.

The primary or secondary monoamines which may be employed in the practice of this invention are $C_8$-$C_{30}$ (preferably $C_{10}$-$C_{20}$) primary or secondary monoamines. Exemplary primary amines include octylamine, dodecylamine, tetradecylamine, hexyldecylamine, octadecylamine, etc.; secondary alkyl amines such as diheptylamine, N,N-ethyl hexylamine, N,N-hexyloctylamine, dioctylamine, N,N-butylhexylamine, etc.; primary and secondary cycloalkyl and alkylcycloalkyl amines such as 2-ethylcyclohexylamine, N,N-ethylcyclohexylamine, N,N-propylcyclohexylamine, etc.; and primary and secondary aryl and alkylaryl amines such as N,N-propylphenylamine, N,N-octylphenylamine, etc.

A preferred class of monoamines are prepared from the vegetable oils and fats. Typical natural oils and fats which may be employed in preparing the monoamines include coconut oil, corn oil, rape oil, castor oil, peanut oil, cottonseed oil, linseed oil, olive oil, palm oil, safflower oil, soybean oil, sperm oil, tung oil, etc. These oils are generally comprised of a mixture of saturated and unsaturated fatty acids such as caprillic, capric, lauric, myristic, palmitic, stearic, oleic, linoleic, etc. The fatty acids are converted into the corresponding primary or secondary amine by conventional processing means. Particularly preferred monoamines are the $C_{10}$-$C_{30}$ primary and secondary vegetable oil amine such as capryl amine, lauryl amine, dilauryl amine, etc., and mixtures thereof.

The N-alkyl terephthalamates may be prepared by either a batch or a continuous processing scheme. In a typical batch process, the reaction vessel, preferably constructed or lined with corrosive resistant material, is charged with a suitable inert reaction solvent, the dialkyl terephthalate and monoamine. The contents of the reactor are stirred to disperse the reactants within the reaction solvent. Boric acid is then introduced into the reaction vessel in contact with the reactants. The temperature of the reactor is then raised to 130° to 460° F, preferably from 200° to 350° F and more preferably from 260° to 300° F. Sufficient pressure is employed to maintain liquid phase reaction conditions which normally varies from 1 to 5 atmospheres and will usually be one atmosphere. The reaction time normally varies from 5 to 50 hours, preferably from 10 to 30 hours and more preferably from 8 to 12 hours.

The concentration of the various reactants within the reaction medium can vary over a wide range depending upon the reactants chosen, the reaction conditions, the processing scheme, and whether a reaction solvent is employed. Generally, however, the reactants will be present in an amount shown in the following Table I.

TABLE I

| Component | Broad Range wt. % | Preferred Range wt. % |
|---|---|---|
| reaction solvent | 0–50 | 15–30 |
| dialkyl terephthalamate | 33–63 | 42–51 |
| monoamine | 50–60 | 55–60 |
| boric acid | 0.1–10* | 0.2–2* |

*Concentration of boric acid based on the weight of reactants present.

The molar ratio of the reactants introduced into the reaction medium will generally vary from 0.8 to 1.5 molar parts of dimethyl terephthalate for every molar part of monoamine. Preferably the molar ratio is 1 to 1.2 molar parts of dimethyl terephthalate to each molar part of monoamine. More preferably, the reactants are present in substantially stoichiometric amounts.

The following example is presented to illustrate the practice of the specific embodiment of this invention and should not be interpreted as limitations upon the scope of the invention.

EXAMPLE 1

This example is presented to illustrate an exemplary preparation of the alkyl terephthalamate intermediate of this invention. A 10-gallon kettle is charged with 17 pounds of dimethyl terephthalate, 23.7 pounds of $C_{18}$ alkyl monoamine, 6.2 pounds of aliphatic thinner having a boiling point of 230° F, and 0.4 pound of boric acid. The contents are heated to a temperature of 230° to 300° F over a 5-hour period and maintained at 300° F for 4 hours. 2.95 pounds of methanol are removed overhead. The product is then stripped at 300° F under a vacuum of 30 millimeters of mercury for 2 hours. A total of 35 pounds are recovered. A sample of this product is analyzed and found to contain 72.4 percent by weight of N-alkyl terephthalamate.

If the boric acid is omitted from the reaction mixture, a higher temperature is required, e.g., 450° F, to get an appreciable rate of reaction. At this temperature a much larger percentage of the diamides is formed at the expense of the desired monoamides.

The intermediate made by the method of this invention is incorporated into a lubricating oil and reacted with sodium hydroxide to form the sodium terephthalamate thickener. Fifteen percent of the sodium terephthalamate thickener is incorporated within the lubricating oil to produce a grease having the following properties: ASTM work penetration of "248", ASTM dropping point (° F) of "590", ASTM rust test of "pass", and a thin film life of 300° F of "28 days"; ASTM high speed bearing test at 325° F, hours to failure is 1700+ hours.

It is apparent that many widely different embodiments may be made without departing from the scope and spirit thereof; and, therefore, it is not intended to be limited except as indicated in the following appended claims.

What is claimed is:

1. A process for preparing an N-alkyl terephthalamate which comprises contacting in a liquid phase reaction medium (1) di($C_1$-$C_4$ alkyl) terephthalate and (2) a $C_8$ to $C_{30}$ primary or secondary monoamine in the presence of 0.1 to 10 weight percent of boric acid based on the weight of said di($C_1$-$C_4$ alkyl) terephthalate and said primary or secondary monoamine.

2. The process defined in claim 1 wherein said di($C_1$-$C_4$ alkyl) terephthalate is dimethyl terephthalate.

3. The process defined in claim 2 wherein said primary or secondary monoamine is a $C_{10}$ to $C_{20}$ primary (alkyl) amine.

4. The process defined in claim 2 wherein said contacting is conducted at a temperature of 130° to 460° F for a period of 5 to 50 hours.

5. The process for preparing an N-alkyl terephthalamate which comprises contacting within an inert hydrocarbon reaction medium (1) dimethyl terephthalate and (2) a $C_8$ to $C_{30}$ monoamine in the presence of 0.2 to 2 weight percent of boric acid based on the weight of said dimethyl terephthalates and said monoamine, said contacting being conducted at a temperature of 250° to 300° F for a period of 10 to 30 hours.

* * * * *